US005367976A

United States Patent [19]

Van Schaik

[11] Patent Number: 5,367,976

[45] Date of Patent: Nov. 29, 1994

[54] ROWING BOAT AND FOOTREST FOR USE THEREIN

[76] Inventor: Bob Van Schaik, No. 246, Obrechtstraat, NL-2517 VD The Hague, Netherlands

[21] Appl. No.: 208,489

[22] Filed: Mar. 9, 1994

Related U.S. Application Data

[63] Continuation-in-part of Ser. No. 965,912, Oct. 23, 1992, abandoned.

[30] Foreign Application Priority Data

Oct. 25, 1991 [NL] Netherlands ..... 9101798

[51] Int. Cl.[5] ..... B63B 35/71

[52] U.S. Cl. ..... 114/347; 114/153; 114/363

[58] Field of Search ..... 114/153, 347, 363; 440/104, 105, 106, 107, 108

[56] References Cited

U.S. PATENT DOCUMENTS

| | | | |
|---|---|---|---|
| 315,743 | 4/1885 | Curlin | 114/153 |
| 413,558 | 10/1889 | Rice | 114/363 |
| 609,956 | 8/1898 | Brosnihan | 114/363 |
| 1,621,423 | 3/1927 | Long . | |
| 2,033,637 | 3/1936 | Kaiser | 114/363 |
| 2,557,972 | 6/1951 | Jewett | 114/363 |
| 2,631,559 | 3/1953 | Jones | 114/153 |
| 2,654,335 | 10/1953 | Ball | 114/153 |
| 3,844,243 | 10/1974 | Caton et al. | 114/153 |
| 3,898,950 | 8/1975 | Martin | 114/363 |
| 4210080 | 2/1890 | Kerns | 114/363 |

FOREIGN PATENT DOCUMENTS

| | | | |
|---|---|---|---|
| 769457 | 8/1934 | France | 114/363 |
| 1275904 | 8/1968 | Germany | B63H 16/02 |
| 3007431 | 9/1981 | Germany | B63H 16/02 |
| 513740 | 2/1955 | Italy | 114/363 |
| 15507 | 9/1896 | United Kingdom | 114/363 |
| 1570678 | 7/1980 | United Kingdom | B63H 16/02 |

*Primary Examiner*—Michael S. Huppert
*Assistant Examiner*—Thomas J. Brahan
*Attorney, Agent, or Firm*—Webb Ziesenheim Bruening Logsdon Orkin & Hanson

[57] ABSTRACT

The invention relates to a rowing boat (1) provided with at least one bench seat (2) displaceable in lengthwise direction of the boat and a footrest (4) placed opposite the bench seat (2), which footrest (4) is pivotable about a lying shaft (5) arranged in transverse direction in the boat (1) and has clamping means (6) for fastening footwear (7) thereto. The pivot shaft (5) can be arranged adjustably in the boat (1). The clamping means (6) can take the form of a toe-clip or of a rotating dish binding.

14 Claims, 4 Drawing Sheets

ROWING BOAT AND FOOTREST FOR USE THEREIN

This is a continuation-in-part of copending application(s) Ser. No. 07/965,912 filed on Oct. 23, 1992, now abandoned.

BACKGROUND OF THE INVENTION

The present invention relates to a rowing boat provided with at least one bench seat displaceable in lengthwise direction of the boat and a footrest placed opposite the bench seat, in addition to a footrest for use in such a boat.

In rowing, and particularly in competition rowing, it is of great importance that a rower can push properly with his feet against a part of the boat when performing his stroke movement so that he can develop the most powerful possible stroke. To this end the point against which the rower pushes off, the so-called pressure point, must preferably remain stationary. Most rowing boats are therefore provided with a fixed footrest.

A significant drawback hereof is that such a fixed footrest does not allow any natural movement of the feet and ankle joints, whereby an optimal stroke movement cannot be performed.

Footrests are also known which are arranged pivotally in the rowing boat, but with these footrests the movement of the foot is left wholly free so that the pressure point is not fixed, whereby less force than desired can be exerted.

SUMMARY OF THE INVENTION

The present invention therefore has for its object to provide a rowing boat with footrest as described above wherein the mentioned drawbacks do not occur. This is achieved according to the invention in that the footrest is pivotable about a lying shaft arranged in transverse direction in the boat and has means for fastening footwear thereto.

The footwear fastening means are preferably formed by clamping means. The fastening of footwear onto the footrest when stepping into the boat is hereby greatly simplified, while clamping means can moveover be quickly released in the case the boat turns over and/or sinks, which furthers the safety of the rower.

The clamping means can take the form of so-called toe-clips (known from the sport of cycling) or rotating dish bindings (known from the sport of skiing). The invention can thus be realized at small cost using components obtainable on a large scale.

When the pivot shaft is arranged adjustably in the boat, any user of the boat can adapt the position of the pressure point to his individual stroke movement.

The footrest is preferably embodied in divided form and the footrest parts are pivotable independently of each other. Small irregularities in the stroke movement can thus be corrected.

When the pivot shaft is in divided form and the shaft parts are adjustable independently of each other, differences in the leg length of an individual rower can also be corrected. This is important for instance when the boat is used for rowing for rehabilitation purposes.

BRIEF DESCRIPTION OF THE DRAWINGS

In one embodiment of the present invention, the footrest is pivotable about an axis substantially perpendicular to the pivot shaft. The footrest is coupled by a pair of cables to a rudder. This arrangement makes it possible to steer the boat with the footrest.

The invention is elucidated hereinbelow in the light of two embodiments, wherein reference is made to the annexed drawing in which corresponding components are designated with corresponding reference numerals, and in which.

DESCRIPTION OF THE PREFERRED EMBODIMENT

Figure 1:
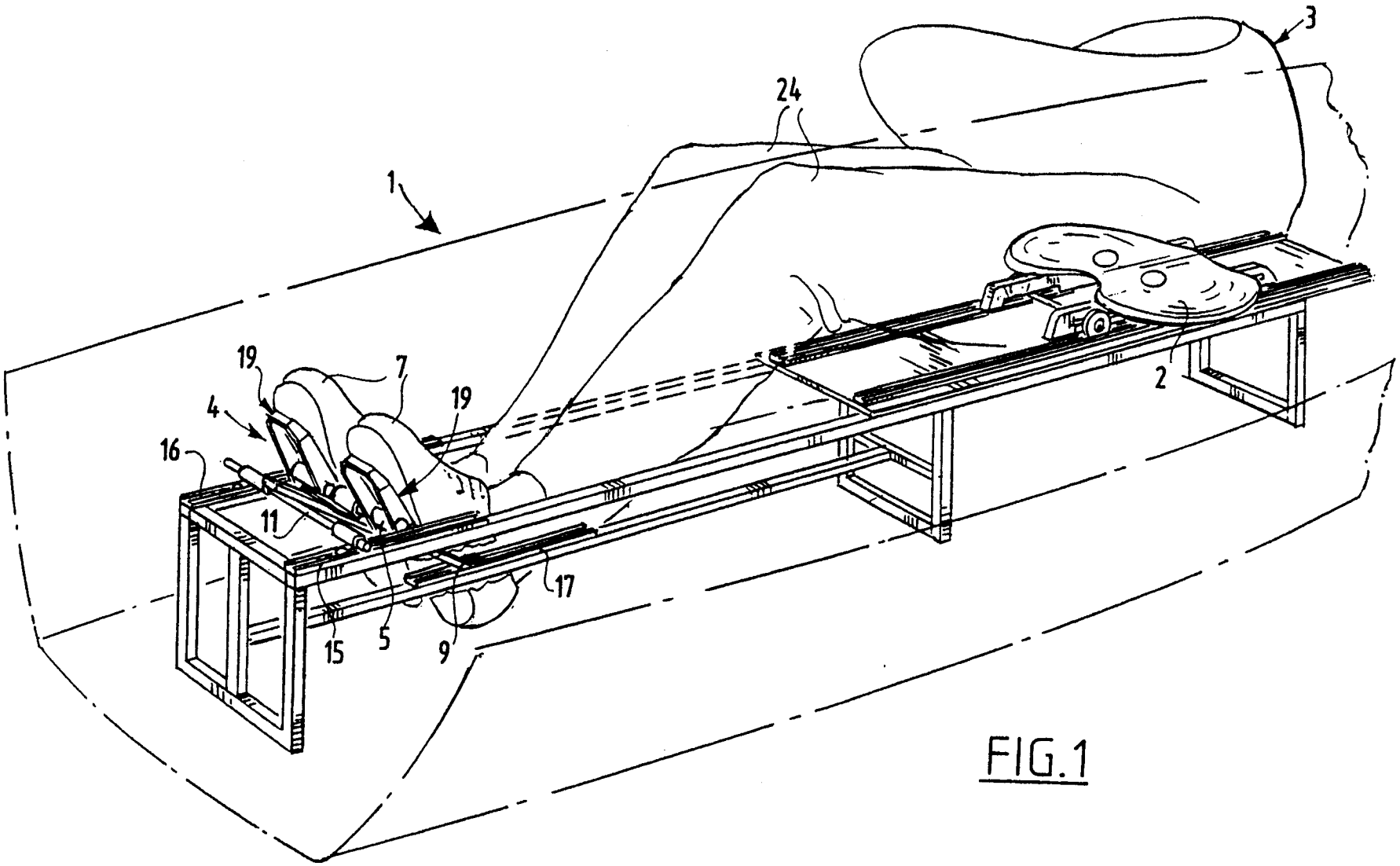
FIG. 1 shows a perspective view of a (schematically shown) rowing boat with footrest according to the invention.

A rowing boat 1 (FIG. 1) comprises at least one bench seat 2 for a rower 3 displaceable in longitudinal direction of the boat 1. Placed at some distance opposite the bench seat 2 is a footrest 4 which is pivotable about a lying shaft 5 arranged transversely in the boat 1. The footrest 4 comprises means 6 (not shown here) for fastening thereto footwear 7 of the rower 3.

Figure 2:
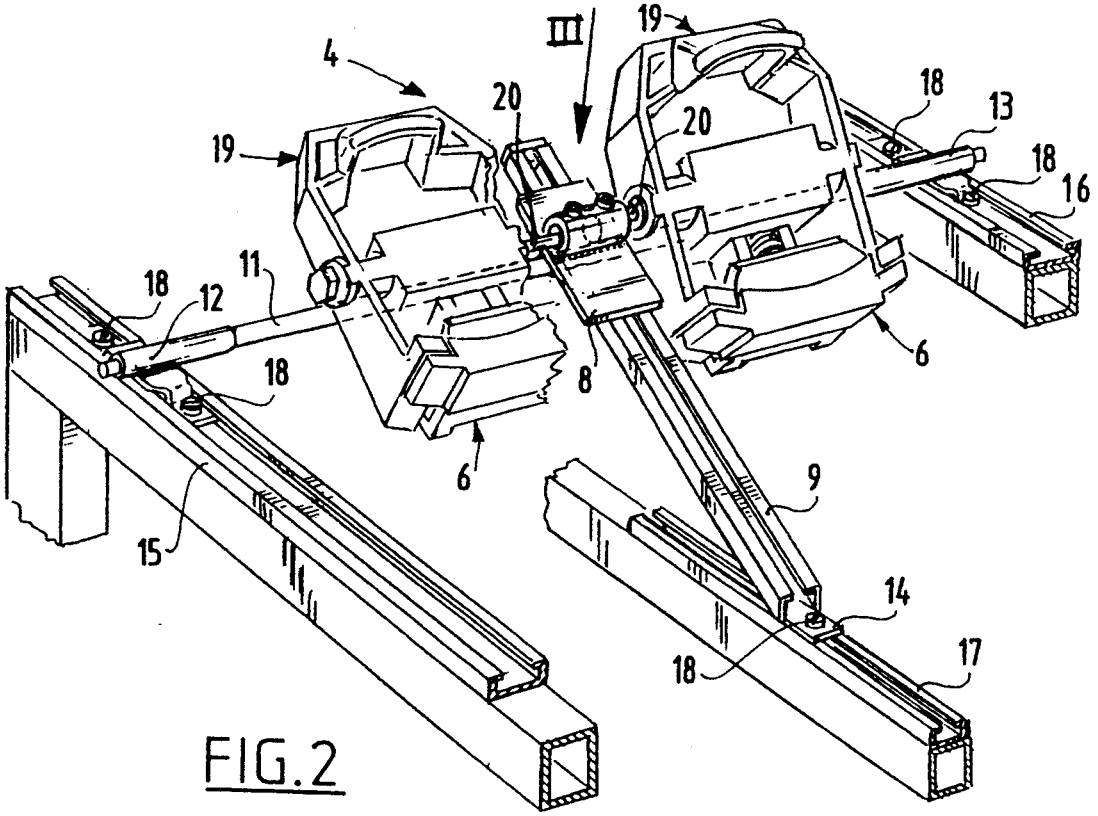
FIG. 2 is a perspective detail view of the footrest shown in FIG. 1.
Figure 3:
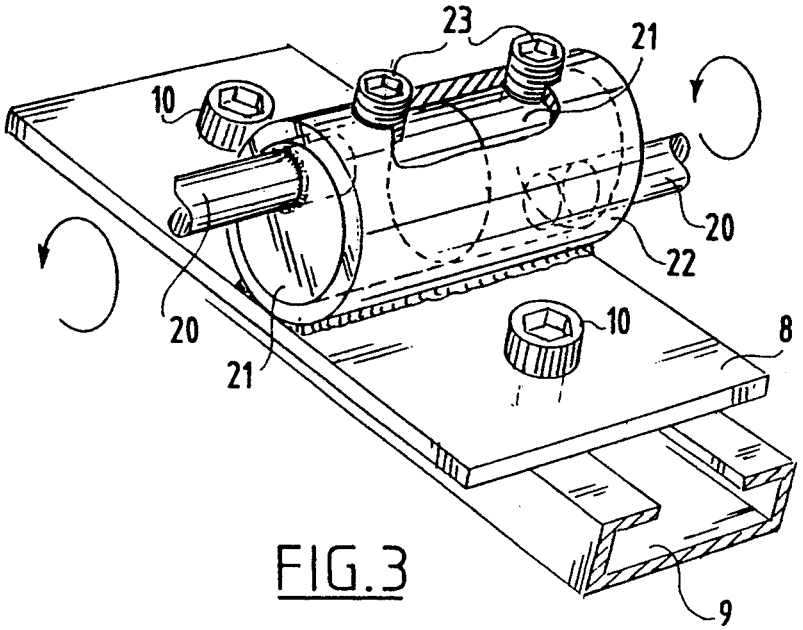
FIG. 3 is a partly broken away detail view along the arrow III in FIG. 2.

The pivot shaft 5 is fixed to a carriage 8 (FIG. 2) which is received slidably in a rail 9. The carriage 8 can be fixed on the rail 9 by means of clamping bolts 10 (FIG. 3). The rail 9 forms together with a cross beam 11 fixed thereto a stiff T-piece, whereof the extremities 12, 13 and 14 are each received slidably in rails 15, 16 and 17 and which can be fixed using clamping bolts 18. The pivot shaft 5 and the footrest 4 connected thereto can thus be adjusted into any position desired by the rower 3.

The footrest 4 takes a divided form and both footrest parts 19 are arranged for pivoting independently of each other on their common pivot shaft 5. Irregularities in the stroke of the rower 3 can hereby be absorbed and corrected.

The pivot shaft 5 can itself also take a divided form (FIG. 2 and 3) and the shaft parts 20 can be arranged for displacement independently of each other on the carriage 8. The shaft parts 20 can for instance each have a thickened outer end 21 which is rotatably received in a sleeve 22 welded on the carriage 8 and which can be fixed in a determined angular position by means of a clamping bolt 23. Length differences in both legs 24 of the rower 3 can for instance be hereby compensated.

Figure 4:
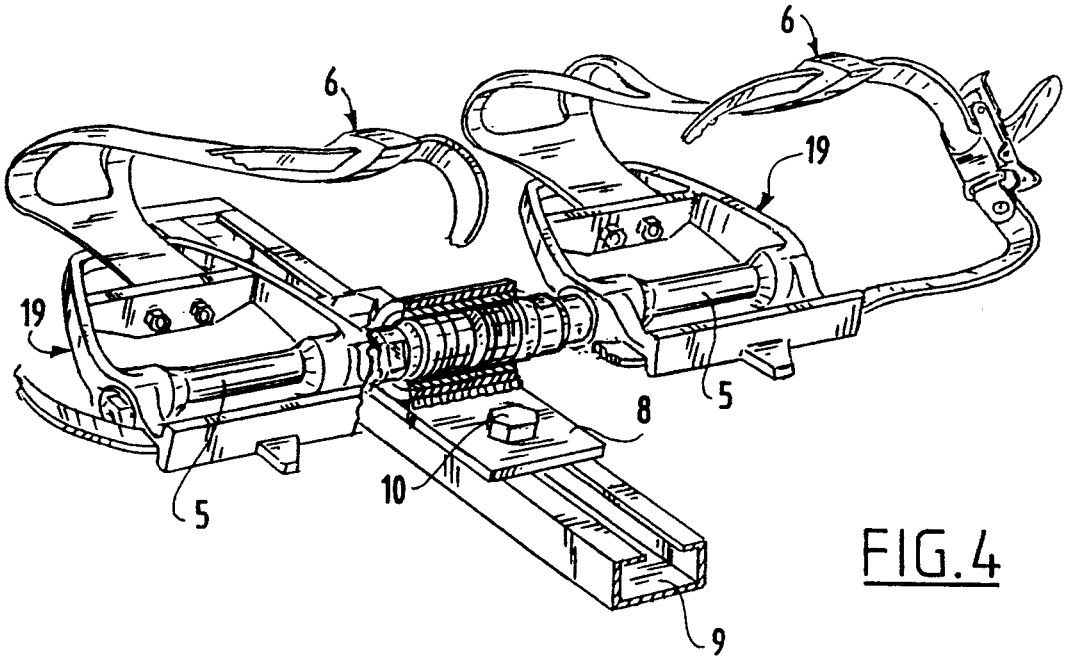
FIG. 4 is a partly broken away view of an alternative embodiment of the footrest according to the invention.

The fastening means 6 for the footwear 7 of the rower 3 can be formed by clamping means. Compared with other fastening methods clamping of the footwear 7 has the advantage of great ease of operation when stepping in and of increased safety in the case of turning over and/or sinking of the boat 1. The clamping means 6 may for instance take the form of rotating dish bindings (FIG. 2), as known from the sport of skiing, or of toe-clips (FIG. 4) as known from the sport of cycling.

Figure 5:
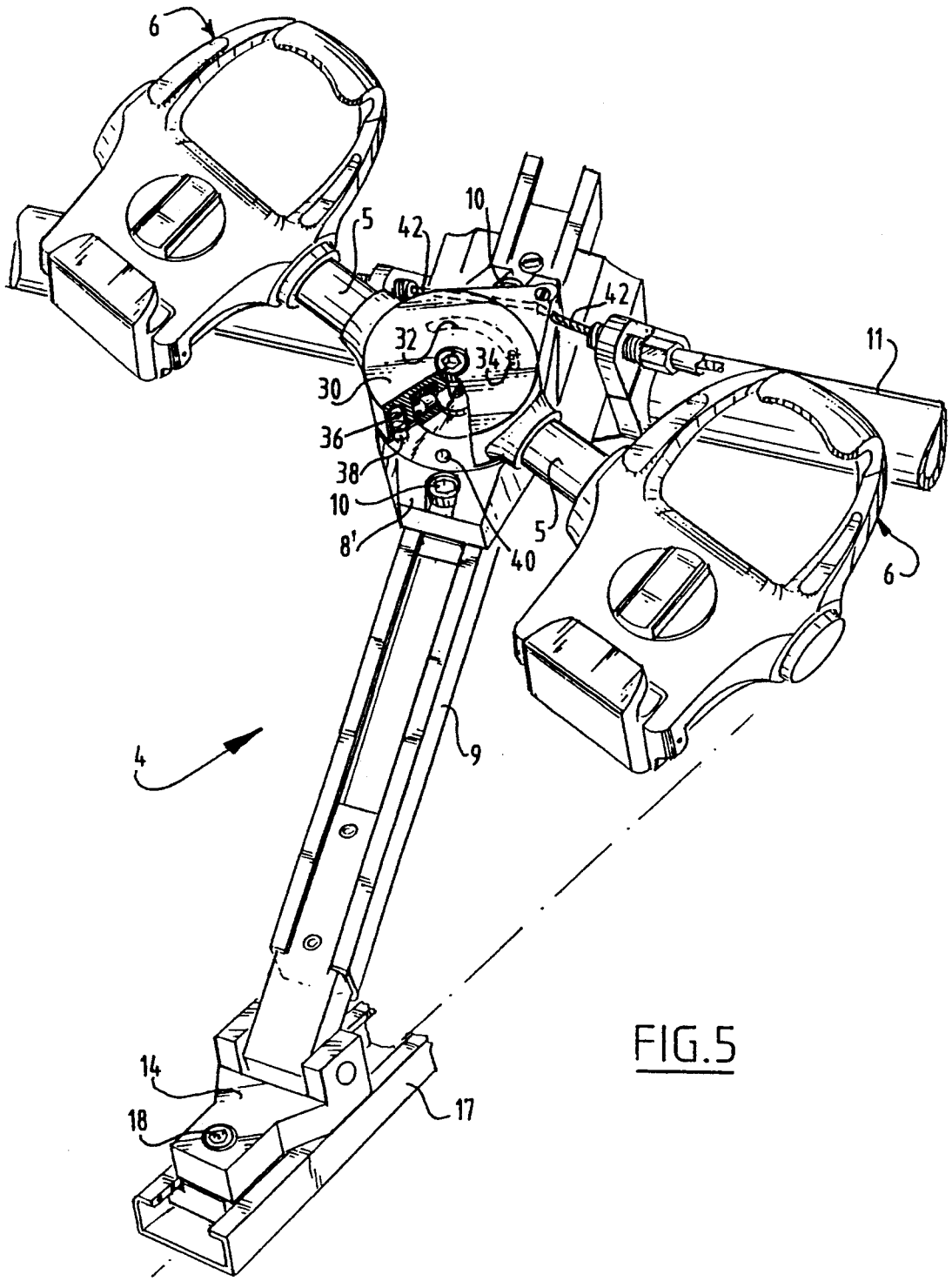
FIG. 5 is a perspective detailed view of an alternative embodiment of a footrest according to the present invention.

FIG. 5 illustrates a modified embodiment of footrest 4, according to the present invention, which provides an extra measure of freedom to make it possible to steer the boat 1 with the footrest 4. In the same manner as the embodiments described above, the footrest 4, shown in FIG. 5, includes lying shaft 5, footwear fastening means 6, rail 9, clamping bolts 10, cross beam 11 with extremity 14, rail 17 and clamping bolts 18. The footrest 4, shown in FIG. 5, differs from the previous embodiment in that an upper carriage 30 is pivotably supported on carriage 8' which is bolted to rail 9 by clamping bolts 10. The footwear fastening means 6, lying shaft 5 and upper carriage 30 pivot relative to carriage 8' about an axis substantially perpendicular to the lying shaft 5. A slot 32 provided in the carriage 8' is configured to receive a pin 34 attached to the upper carriage 30. The pin 34 and slot 32 connection will limit the movement of the upper carriage 30, lying shaft 5 and footwear fastening means 6. As shown in FIG. 5, the lying shaft 5, fastening means 6 and upper carriage 30 are configured for pivoting movement to about 30° left and 30° right of the centered position. A spring 36 will bias a detent member 38 against an upper surface of the carriage 8'. A locking hole 40 is provided in the upper surface of the carriage 8' to receive the detent member 38 when the upper carriage 30 is in the centered position. The spring 36, biased detent member 38 and locking hole 40 help maintain the upper carriage 30 in the centered position. A pair of cables 42 is coupled to the upper carriage 30 and is connected to a rudder (not shown) of the boat 1. The pivoting of the upper carriage 30 about the axis perpendicular to the lying shaft 5 will provide for a steering of the boat 1 by controlling the rudder through connecting cables 42. In addition to steering the boat with the footrest 4, the embodiment in FIG. 5 contains all of the advantages of the previous embodiments discussed above.

I claim:

1. A rowing boat provided with at least one bench seat displaceable in a lengthwise direction of said boat and a footrest placed opposite said bench seat, which said footrest is pivotable about a pivot shaft during a rower's stroke arranged in transverse direction with respect to said lengthwise direction of said boat and has means for fastening footwear thereto and means to adjust the height of said pivot shaft to position said footrest in any one operative position within a continuous range of operative positions, wherein said footrest is pivotable about an axis perpendicular to said pivot shaft and further including means for controlling a rudder of said boat coupled to said footrest.

2. A rowing boat as claimed in claim 1, wherein said footwear fastening means are formed by clamping means.

3. A rowing boat as claimed in claim 2, wherein said clamping means take the form of at least one toe-clip.

4. A rowing boat as claimed in claim 2, wherein said clamping means take the form of at least one rotating dish binding.

5. A rowing boat as claimed in claim 1, wherein said means for controlling said rudder includes a pair of cables extending between said footrest and said rudder.

6. A rowing boat provided with at least one bench seat displaceable in a lengthwise direction of said boat and a footrest placed opposite said bench seat, which said footrest is pivotable about a pivot shaft arranged in transverse direction with respect to said lengthwise direction of said boat and has means for fastening footwear thereto and means to adjust the height of said pivot shaft to position said footrest in one of a plurality of operative positions, wherein said footrest includes a pair of footrest parts mounted on shaft parts of said pivot shaft and said footrest parts are pivotable about said shaft parts of said pivot shaft independently of each other.

7. A rowing boat as claimed in claim 6, wherein said pivot shaft includes said pair of shaft parts and said shaft parts are adjustable independently of each other.

8. A boat comprising:

at least one bench seat displaceable in a longitudinal direction of said boat; and a footrest means associated with each said bench seat including at least one footrest portion pivotally mounted upon a shaft adapted to pivot during a rower's stroke, the longitudinal axis of said shaft being substantially transverse to said longitudinal direction of said boat, and a footwear fastening means coupled to said footrest portion;

wherein said shaft is mounted to an adjustable carriage for adjustably positioning the height of said footrest means within said boat, wherein said footrest means includes a pair of said footrest portions, and wherein each said footrest portion is pivotable independent of the other of said footrest portions.

9. The boat as claimed in claim 8, wherein each said footrest portion is adjustable with respect to said carriage.

10. The boat as claimed in claim 8, wherein a pair of footrest portions are provided and said shaft includes two pivot shaft portions with each pivot shaft portion having one of said footrest portions pivotally mounted thereon independent of the other of said pair of footrest portions wherein said pivot shaft portion of each said footrest portion includes a thickened eccentric outer end which is rotatably received in a stationary sleeve coupled to said carriage and which can be fixed in a determined angular position by a clamping bolt.

11. A footrest comprising:

a pair of footrest portions each said footrest portion pivotally mounted upon a respective shaft portion and a footwear fastening means coupled to each said footrest portion, wherein said pivot shaft portions of said pair of footrest portions are mounted to an adjustable carriage for adjustably positioning said footrest;

wherein each said footrest portion is pivotally independent of the other of said footrest portions;

wherein each said footrest portion is independently adjustable relative to said carriage, and wherein said pivot shaft portions of each said footrest portion include a thickened eccentric outer end which is rotatably received in a stationary sleeve coupled to said carriage and which can be fixed to a determined angular position by a clamping bolt.

12. The footrest as claimed in claim 11, wherein said footwear fastening means is a clamping means.

13. A boat comprising:

at least one bench seat displaceable in a longitudinal direction of said boat;

a controllable rudder;

a footrest means associated with each said bench seat including at least one footrest portion pivotally mounted upon a shaft, the longitudinal axis of said shaft being substantially transverse to said longitudinal direction of said boat, and a footwear fastening means coupled to said footrest portion, wherein said shaft is mounted to a rotatable upper carriage rotatably about an axis substantially perpendicular to said shaft, and said rotatable upper carriage is mounted to an adjustable carriage configured for adjustably positioning the height of said footrest means within said boat; and means for controlling said rudder coupled to said rotatable upper carriage.

14. The boat as claimed in claim 13, wherein said means for controlling said rudder includes a pair of cables extending between said upper carriage and said rudder.

* * * * *